United States Patent [19]

Matuda et al.

[11] Patent Number: 4,725,327

[45] Date of Patent: Feb. 16, 1988

[54] LABELING ROBOT

[75] Inventors: Yasuhiko Matuda; Norio Abe, both of Iwate, Japan

[73] Assignee: Kabushiki Kaisha Sato, Japan

[21] Appl. No.: 774,349

[22] Filed: Sep. 10, 1985

[30] Foreign Application Priority Data

Sep. 11, 1984 [JP] Japan ..... 59-190207

[51] Int. Cl.[4] ..... B65C 9/10; B65C 9/41; B65C 9/42

[52] U.S. Cl. ..... 156/351; 156/497; 156/571; 156/572; 156/DIG. 29; 156/DIG. 31; 156/DIG. 45

[58] Field of Search ..... 156/285, 351, 358, 497, 156/571, 572, DIG. 29, DIG. 31, DIG. 45, 363

[56] References Cited

U.S. PATENT DOCUMENTS

| | | | |
|---|---|---|---|
| 3,476,632 | 11/1969 | Cornelius | 156/570 |
| 3,751,321 | 8/1973 | Hagemann et al. | 156/572 |
| 3,816,221 | 6/1974 | Shank | 156/572 |
| 4,025,382 | 5/1977 | Del Rosso | 156/DIG. 31 |
| 4,236,954 | 12/1980 | Edwards | 156/572 |
| 4,479,644 | 10/1984 | Bartimes | 264/40.3 |
| 4,498,854 | 2/1985 | Ross | 156/572 |
| 4,595,447 | 6/1986 | Lindstrom | 156/571 |
| 4,618,392 | 10/1986 | Uchimura | 156/497 |

FOREIGN PATENT DOCUMENTS

| | | | |
|---|---|---|---|
| 0012314 | of 1913 | United Kingdom | 156/DIG. 31 |
| 1418916 | 12/1975 | United Kingdom | 156/358 |

*Primary Examiner*—Michael Wityshyn
*Assistant Examiner*—J. Davis
*Attorney, Agent, or Firm*—Ostrolenk, Faber, Gerb & Soffen

[57] ABSTRACT

A labeling robot system comprises a suction plate which uses vacuum action to pick up an adhesive label by its printed surface. Air cylinders operated by compressed air orient and move the suction plate to the object to be labeled to stick the label thereon, and limit switches linked to a sequence controller define the limit of the strokes and the degree of turning involved.

12 Claims, 12 Drawing Figures

D
C
B
A
53
51
52
50
9
f
e
d
c
b
a
6
4b
5
S-2
8
10a
12
13a
13b
C
S-3
Z
S-4
29
30
35
28
63
62
15
34
13
14
S-7
S-5
15a
15b
2
1
S-1
3
Y
4a
45
A
2a
2b
9
7
11
X
S-6
44
10b
B
7b
7a
42
40
41

LABELING ROBOT

BACKGROUND OF THE INVENTION

This invention relates to a pneumatic labelling robot or apparatus whereby a label, printed as required by a printer or the like, is peeled from a tape-shaped support carried on a label stand, is picked up by a suction plate of the robot and is then applied to an object which is transported past the robot on a conveyor.

SUMMARY OF THE INVENTION

The object of the present invention is to provide an efficient labeling robot system extending from label suction through to label application in which a suction plate descends vertically to suck a desired label from a label support, ascends vertically, turns through 90° to a horizontal orientation, and then moves in a level horizontal direction to apply the label to an object. Thereafter, the suction force on the label ceases and the suction plate retracts and turns downwards through 90° to return to its original position.

To achieve the above object in the labelling robot according to the present invention, limit switches are positioned to sense the vertical strokes, horizontal strokes, turning and label suction action and are connected to a sequence controller. A pneumatic control is connected to the sequence controller, and air pressure conduits for each of the said strokes and the suction plate are connected to an air pressure source which causes a preprogrammed movement and operation of the suction plate.

DETAILED DESCRIPTION OF THE PREFERRED EMBODIMENT

Figure 1:
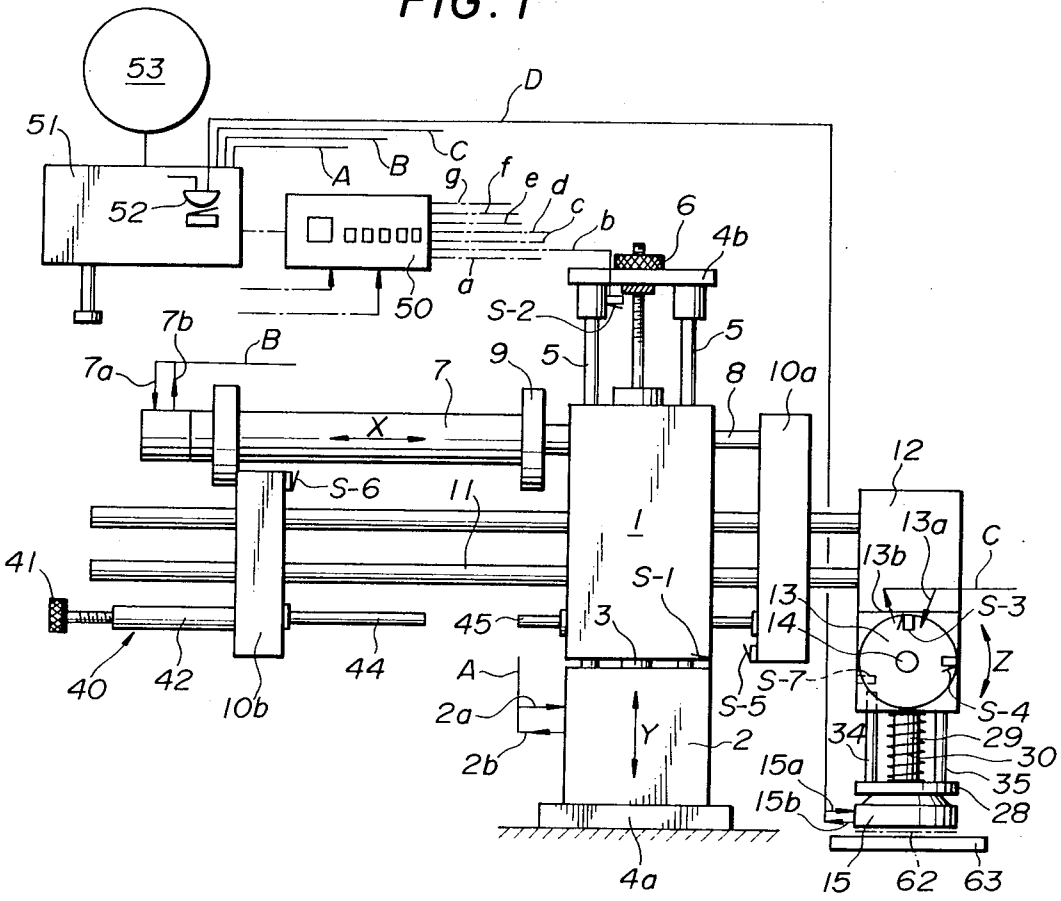
FIG. 1 is an elevation view of the labelling robot of the present invention and schematically shows the controls by which the suction plate is lowered and a label attached thereto by suction force.
Figure 2:
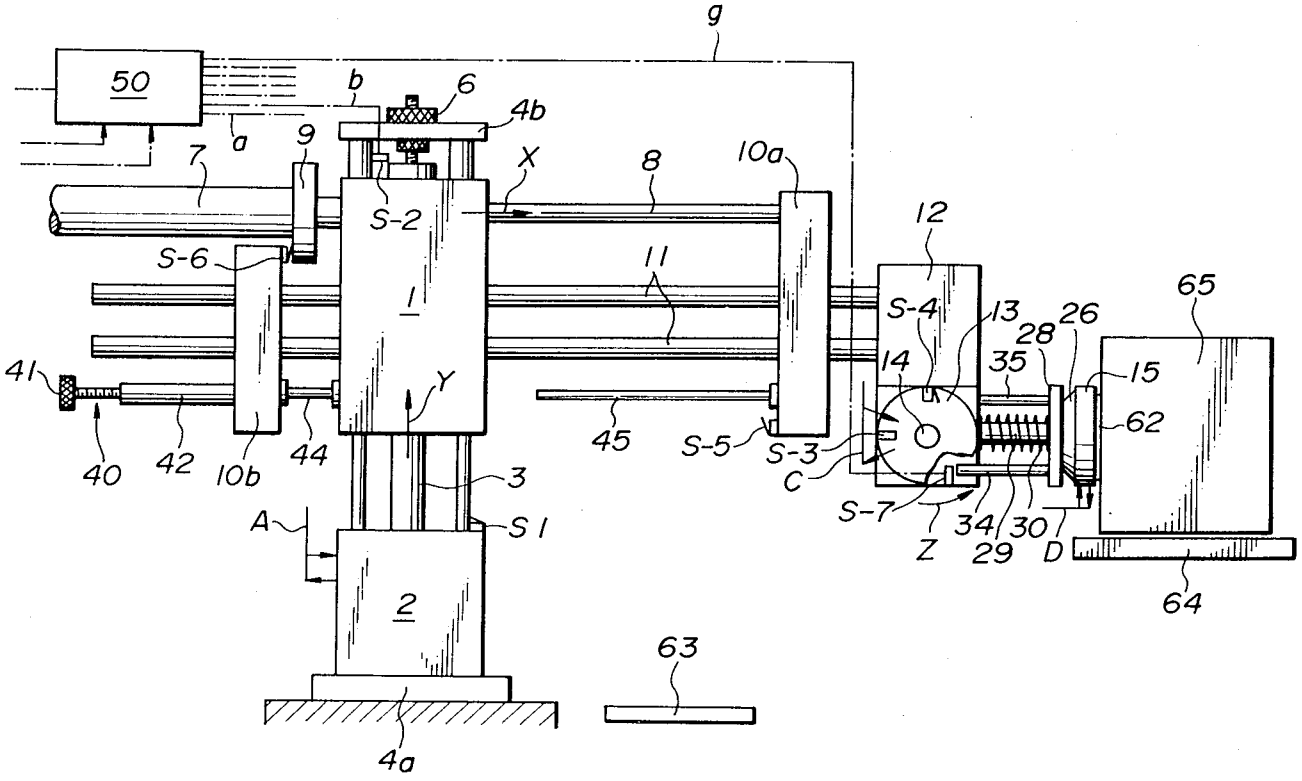
FIG. 2 shows the labelling robot of FIG. 1 with the suction plate moved to a label-applying position and shows the object to which the label is to be applied.

With reference to FIGS. 1 and 2, air compressor 53 supplies compressed air to a suction plate 15 located at an extremity of main unit 1 of the labeling robot, moves plate 15 with reciprocal motion in a vertical direction Y, a horizontal direction X, and with turning motion around an axis in the Z direction through 90°.

More specifically, with respect to reciprocal motion in the vertical Y direction, compressed air is supplied to the air cylinder 2 via the air intake, line **2*a* or to air outlet 2*b*. The control of pressure in cylinder 2 moves piston rod 3 in the main unit 1. A pair of guide rods 5 are disposed in parallel with the piston rod 3. Guide rods 5 are fixed between base 4*a* and an upper support portion 4*b*, and stabilize the vertical motion of the main unit 1. A centrally located vertical stroke adjustment member 6 is fixed to member 4*b*. To provide compressed air to the air cylinder 2, a control signal is transmitted from sequence controller 50 to the air control box 51, causing compressed air to be sent from the air compressor 53 to cylinder 2 via the air passage A. Clearly, as piston rod 3 moves main unit 1 up and down, the suction plate 15** moves in a parallel direction by the same distance.

Horizontal reciprocal motion is obtained by the horizontal motion of an advance arm **10*a* which is connected to a piston rod 8. Piston rod 8 is moved by compressed air being provided to or removed from intake 7*a* or outlet 7*b* respectively of horizontal air cylinder 7, via air passage B. The advance arm 10*a* is fixed to a pair of guide rods 11 which are slidably mounted in the main unit 1, and are fixed at one end to the head block 12 of a rotation air cylinder 13. As piston rod 8 moves horizontally, the suction plate 15** also moves horizontally.

With respect to the Z direction motion of rotation, a rotary or turning motion about the axis of a shaft 14 through 90° is effected by applying compressed air to intake **13*a* or to outlet 13*b***, through the air passage or conduit C.

Suction plate 15 is fixed to the end of the air cylinder 13 and piston rod 29. Suction plate 15 is made of light aluminum, and forms the working head of the robot. Air intake **15*a* and air outlet 15*b* of the suction plate 15 are connected, via a conduit D, to the air control box 51 which contains a vacuum switch 52. The suction plate 15 can be connected to low pressure or vacuum for the label sucking action, the low pressure air being derived from compressor 53** through a suitable solenoid valve (not shown).

Figure 6:
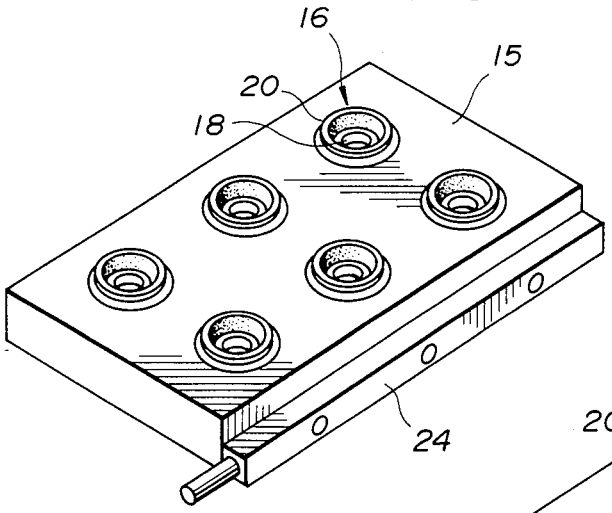
FIG. 6 is a perspective view of a suction plate for relatively large labels.
Figure 7:
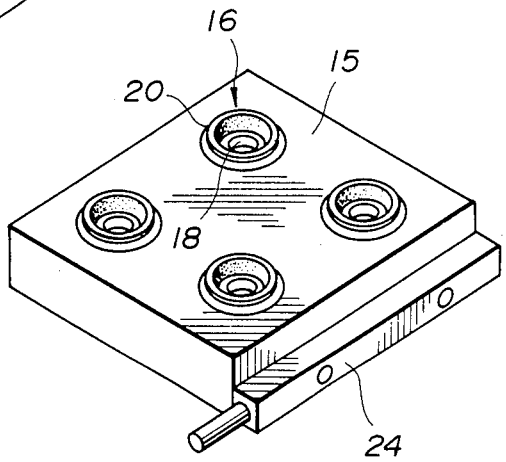
FIG. 7 is a perspective view showing a suction plate for smaller labels than those received by the plate of FIG. 6.
Figure 10:
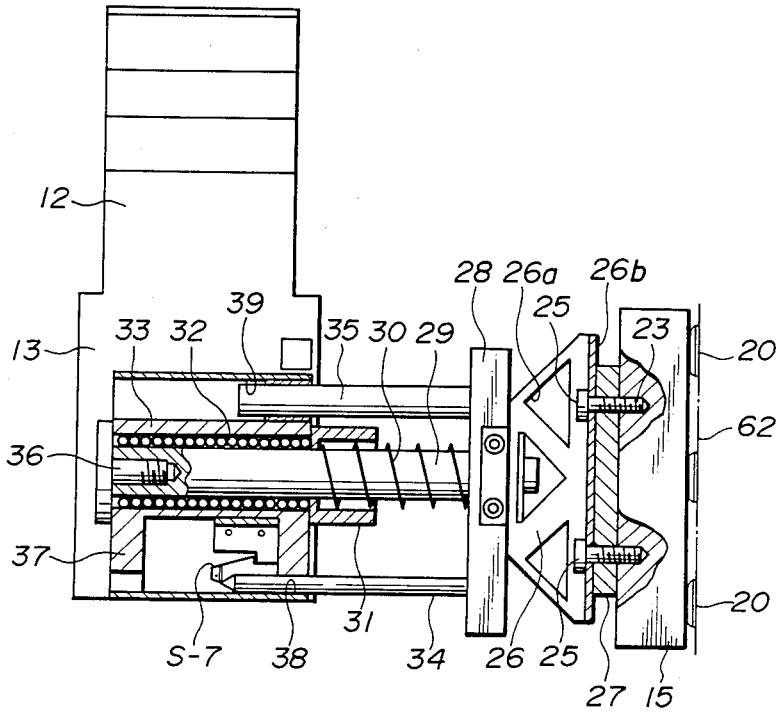
FIG. 10 is a cross-sectional view of the head portion of the labeling robot of FIGS. 1 and 2.

The suction plate 15 is next described in further detail, with reference to FIGS. 6 and 10. For large labels the large suction plate of FIG. 6 is employed, and for normal sized labels, a smaller, or normal type suction plate shown in FIG. 7 is employed. Both suction plates are basically similar in construction, the differences being the effective area of the suction surface and the number of suction elements. Thus six suction elements are in the plate of FIG. 6 and four suction elements are in the plate of FIG. 7. The suction elements 16 are each provided with suction pads 20 and are screwed into the upper suction surface of plate 15.

Figure 8:
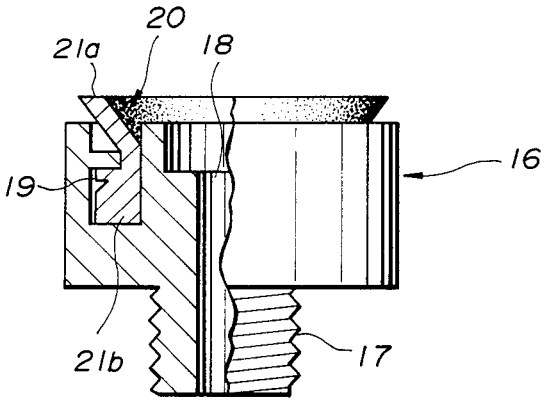
FIG. 8 is a cross-sectional view of any one of the suction elements of the plates of FIGS. 6 and 7 and shows a suction pad which is screwed into the suction plate.

As shown in FIG. 8, each suction element 16 is provided with a threaded extension 17. A suction hole 18 passes through the middle of the threaded extension 17 and the main body. An annular channel is formed in body 16. Channel 19 receives the boss **21*b* of the suction pad 20**, which is formed of soft rubber material. The suction portion 21*a* of the suction pad 20 is in the shape of a cone and is thin and resilient.

Figure 9A:
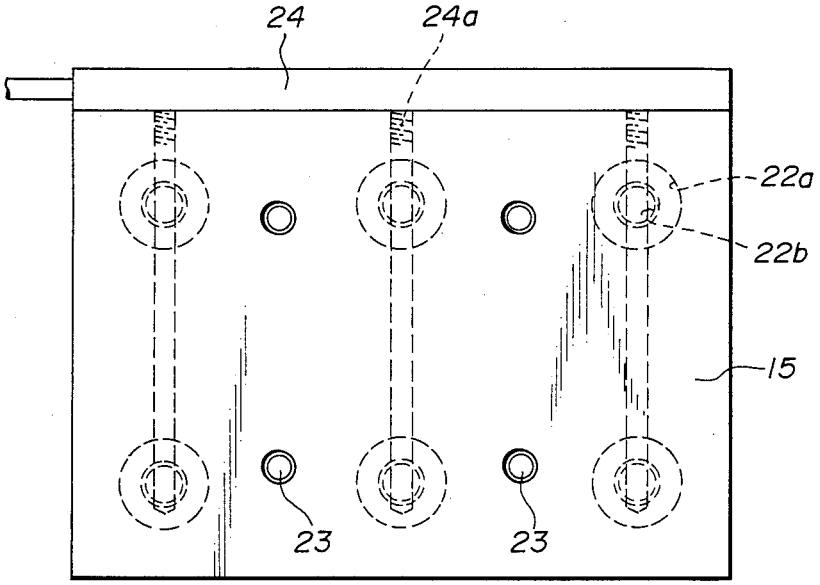
FIG. 9A is a plan view of the bottom of the suction plate of FIG. 6.
Figure 9B:
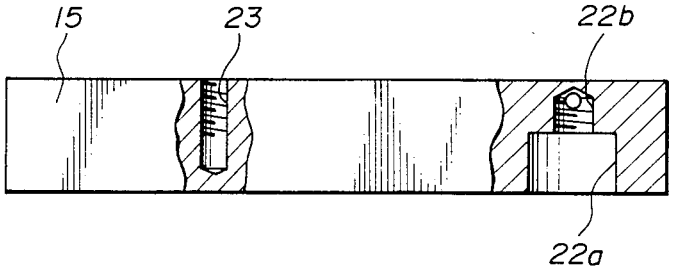
FIG. 9B is a side view of the suction plate of FIG. 9A, shown partially in cross-section.

As can be seen in FIGS. 9A and 9B, each suction element 16 with its suction pad 20 fits into a respective hole 22*a* in suction plate 15. Each hole 22*a* is provided with a threaded portion 22*b*, which receives threaded extension 17 of a respective element 16. An air pipe 24 is attached to one side of the suction plate 15. Air pipe 24 is connected between the air compressor 53 and air passage 24*a*, in the opening 22*a*. The cone-shaped end of the suction pad 20 of each suction element projects slightly above the upper surface of the suction plate 15 (see FIG. 10).

The attachment of the suction plate 15 to the rotation air cylinder 13, and their internal construction, will now be explained with reference to FIG. 10.

Bolts 25 extend through metal plate 26*b*, and connecting plate 27 are threaded into tapped openings 23 in plate 15. Metal plate 26*b* is attached to a shock absorbing member 26, formed of rubber material, which is in turn, attached to a support member 28. To provide good shock absorbency, the shock absorbing member 26 is provided with hollow portions 26*a* at appropriate locations. Attached to the center of support member 28 is a piston rod 29. A spring 30 normally biases piston rod 29 to the right. A detector rod 34 is attached to the support member 28 on one side of the piston rod 29 and a guide rod 35 is attached to support member 28 on the other side of piston rod 29. The left hand end of spring 30 of the rod 29 is disposed within a spring holder 31 which is resiliently pressed against and maintained by an auxiliary spring 32. The auxiliary spring 32 is housed in a sleeve 33 which is in contact with spring holder 31, and is supported by a fastener 36 on the end of the piston rod 29.

A leg portion 37 of the sleeve 33 is provided with an opening 38 which receives detector rod 34. A limit switch S-7 is positioned to receive the end of the slidable rod 34 which can contact or separate from the end of the rod 34. Limit switch S-7 is connected to the sequence controller 50 by an electrical circuit g which is described below. The upper portion of the sleeve 33 in FIG. 10 is provided with a guide opening 39 which receives guide rod 35, and enables smooth advance and retraction of the rod 29.

Figure 11:
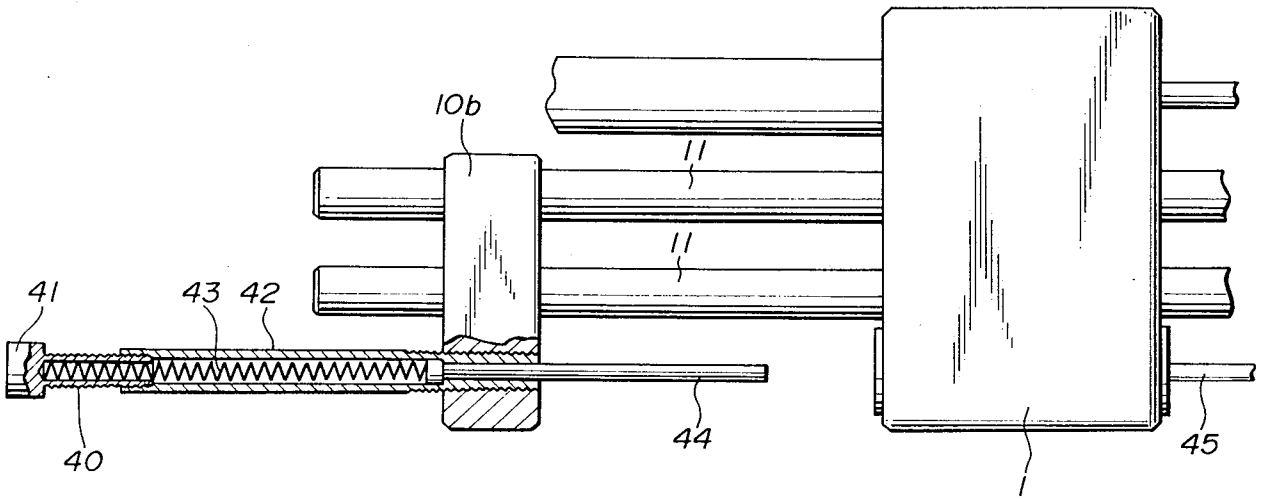
FIG. 11 is a partial cross-sectional side view of a shock adjustment member of FIGS. 1 and 2.

As shown in FIGS. 1, 2 and 11, a shock adjustment member 40 is provided for adjusting the horizontal stroke of the labeling robot and for easing the impact on retract arm 10*b* at the moment of contact between plate 15 and a labeling object 65 (FIG. 2). In further detail, with reference to FIG. 11, the retract arm 10*b* has a cylinder 42 fixed thereto which houses a shock absorber spring 43. A cylindrical threaded adjuster shaft 41 is provided at the left hand end of spring 43. The other end of spring 43 is in contact with a piston rod 44. The piston rod 44 is attached to face shock absorber rod 45 which is fixed to advance arm 10*a* (FIG. 1). Rod 44 is freely slidable relative to the main unit 1.

Referring again to FIGS. 1 and 2, limit switches S-1 to S-7 are connected to sequence controller 50. Limit switches S-1 to S-7 are disposed at the positional limits of the horizontal, vertical and rotational strokes of the labeling robot. Specifically, DOWN limit switch S-1, which defines the lower limit of movement of the main unit 1, is connected to the sequence controller 50 by the circuit a. The UP limit switch S-2, which defines the upper limit of movement, is connected to the sequence controller by the circuit b. The ADVANCE limit switch S-5 defines the forward limit of movement of the advance arm 10*a* and is connected to controller 50 by circuit e. RETRACT limit switch S-6 defines the retraction limit of arm 10*a* and is connected to controller 50 by circuit f. ANGLE limit switch S-3 and STOP-TURNING limit switch S-4 define, respectively, the upward and downward rotational limits of the rotation air cylinder 13 and are connected to controller 50 by circuits c and d, respectively. Limit switch S-7, which provides confirmation of label attachment to the suction plate 15, is disposed at the front end of the rotation air cylinder 13, and is connected to controller 50 by circuit g.

Figure 5:
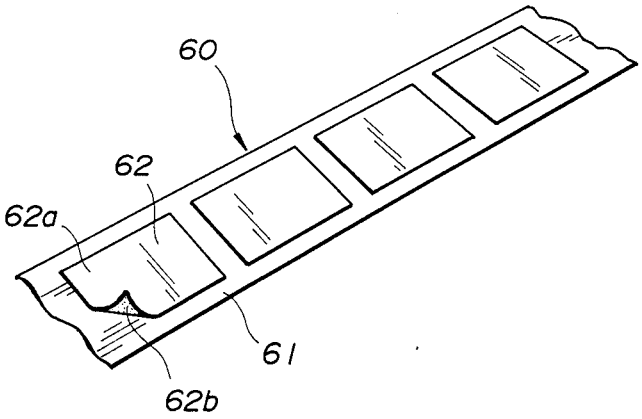
FIG. 5 is a perspective view of a label-supplying strip.

The apparatus of the invention can be used to apply any of a wide variety of labels to objects. Label 62 illustrated in FIG. 5 is typical. Label 62 has a printed side 62*a* and a reverse adhesive side 62*b*, which is tacked onto e.g. removably attached, to a release surface of a tape-shaped support 61. A plurality of labels are on tape 61. The print side 62*a* of the label is suitably printed by a printer or other such means, and carries information such as a part number, or production number, destination, or other such indication, including those which can be encoded in bar code form. The tapeshaped support 61 is appropriately moved to position the printed labels 62 on a label stand 63 (see FIGS. 1 and 2) by any appropriate mechanism (not shown).

The actions of sucking up labels and affixing the labels to an object according to this invention will now be described with reference to FIGS. 1 and 4.

Figure 3:
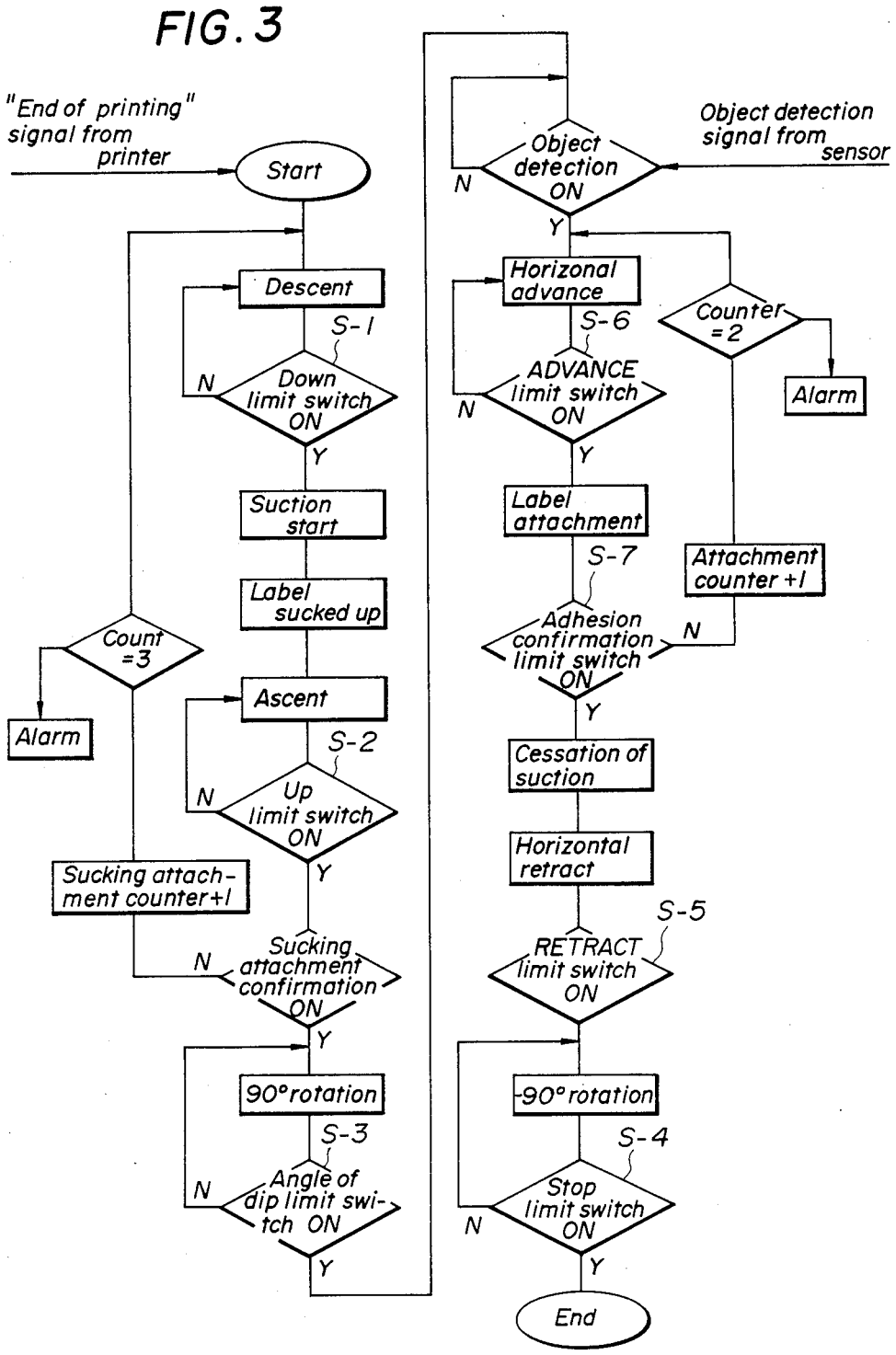
FIG. 3 is a flow diagram showing the sequence of functions of the labeling robot control system.

The printer for printing the labels (not shown) is connected to the sequence controller 50, and after completion of the printing outputs an END OF PRINTING signal to the sequence controller (FIG. 3). The sequence controller then outputs a START signal to the air control box 51 to start the air compressor 53. The compressed air from the air compressor 53 is fed to the labeling robot to effect the various vertical, horizontal and turning functions, and in the case of the suction plate 15, is converted by means of the solenoid valve into suction force as will be later described with reference to FIG. 3.

The following stroke adjustments are made prior to the commencement of the operation of the robot. Specifically, with reference to FIG. 2, adjustments are carried out to match the vertical strokes to the height of the object 65 to be labelled, which is brought into position on a conveyor 64 positioned in front of the labeling robot, and to match the horizontal strokes to the distance from the robot to the object 65.

The height of the vertical stroke is adjusted by adjusting stroke adjustment member 6 to set the height at which the UP limit switch S-2 operates. Adjustment of the horizontal forward stroke is adjusted by adjusting the shock adjustment member 40 to set the distance at which the ADVANCE limit switch S-6 operates. The DOWN limit switch S-1 for the stroke down to the stand 63 on which the label is located is in a fixed position.

With reference to FIGS. 1, 2, 3 and 4, following a START signal, the appropriate label has been printed and located in a pickup position. Compressed air from the air compressor 53 is then supplied via the air control box 51 to air passage A to the vertical air cylinder 2. The main unit 1 then commences its downstroke to the position of FIG. 1. With this downward movement of the main unit 1, the advance arm 10*a*, rotation air cylinder 13 and the suction plate 15 move down toward the label 62 which is readied on the label stand 63. When the DOWN limit switch S-1 closes, the suction circuit D comes ON, and the sucking action of the suction plate 15 commences, causing the label 62 to be sucked up by the suction force of the suction pads 20. The suction pads 20 deform with the action of sucking up the label, causing the pads to become flush with the surface of the suction plate 15.

Line 2*b* is then pressurized and the vertical air cylinder 2 raises the suction plate 15 with the label attached thereto. Once the desired height is reached, the UP limit switch S-2 is closed. This is followed by confirmation that a label is being held by the suction plate 15, said confirmation being carried out by vacuum switch 52 which detects the degree of vacuum of the suction plate 15. The vacuum switch 52 provides the labeling robot system with the means for confirming that the label was picked up.

If the confirmation is negative, the head 15 is again moved down to pick up a label. If confirmation remains negative even after several retries (three tries in FIG. 3), a warning is issued. As shown in FIG. 3, in cases of negative confirmation of label attachment, the system retrace extends back to the step preceding the downward stroke, i.e. to the END OF PRINTING steps.

If label pickup by the suction plate 15 was normal the system proceeds to the next stroke, whereby the suction plate 15 is raised to the necessary height defined by limit switch S-2. Next, compressed air is supplied to the rotation air cylinder 13, rotating the suction plate 15 by 90° counterclockwise, to the point at which the limit switch S-3 closes. This rotation therefore brings the suction plate 15 to the horizontal position shown in FIG. 2, facing the object 65 to be labeled.

Figure 4:
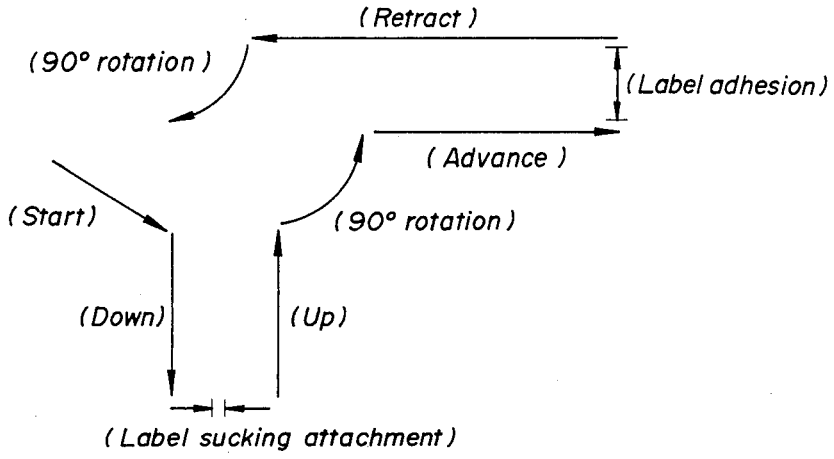
FIG. 4 is an explanatory diagram of the sequence of functions of the flow diagram of FIG. 3.

Next, with reference to FIGS. 2 and 4, when a sensor (not shown) provided on the side of the conveyor 64 is reached by the object 65 it communicates this by outputting an object detection signal to the sequence controller 50. Preferably the circuitry is such that this signal is transmitted to the printer to start the printing of the next label.

Upon generation of the object detection signal, the forward stroke or horizontal advance of the suction plate 15 commences. Specifically, compressed air is supplied to the horizontal air cylinder 7. The advance arm 10*a*, retract arm 10*b* and suction plate 15 at the front end of the rotation air cylinder 13 with the label 62 attached thereto advance horizontally towards the object 65. The printed side 62*a* of the label 62 is in contact with the suction pads 20 of the suction plate 15, and the adhesive side 62*b* of the label 62 faces the object 65. When label 62 contacts object 65, label 62 will stick in place on object 65. Roughly simultaneously with this the ADVANCE limit switch S-6 and the label attachment confirmation limit switch S-7 switch turn ON. With regard particularly to limit switch S-7, as the suction plate 15 comes into contact with the object 65 spring 30 compresses, and the tip of detector rod 34 moves sufficiently to trigger the limit switch S-7 as will be understood from FIG. 10.

The impact energy generated in suction plate 15 at the moment of attachment of the label to object 65 is absorbed by the shock absorbing material 26 with its hollow portions 26*a*, provided at the back of the suction plate 15, and by the spring 30 and auxiliary spring 32. The impact energy is also absorbed by the shock adjustment member 40, as the energy of the piston rod 44 on the shock absorber rod 45 of the advance arm 10*a* is transmitted to and absorbed by the shock absorber at the end of said rod (FIG. 11).

If at this time and as shown in FIG. 3, a negative confirmation of label attachment is issued, and the sequence of operations beginning with horizontal advance, is repeated. If confirmation after two tries is still negative a warning is issued.

If confirmation of label attachment is positive (ON), the vacuum is removed from the suction plate 15 and compressed air is supplied to the horizontal air cylinder 7, horizontally retracting the suction plate 15 until the RETRACT limit switch S-5 is triggered ON.

Next, compressed air is supplied to the rotation air cylinder 13 to rotate the suction plate 15 through 90° counterclockwise. With this rotation the suction plate 15 faces downwards, reverting to the restart condition. When the STOP (angle of dip) limit switch is triggered ON, the system has returned to the original position of FIG. 1.

The above sequence of actions comprise one system cycle from picking up a printed label by suction to the application of the label on the required object at the required location on the object. The information printed on the label as well as the size and type of the label, and the object, may be varied as required.

Thus, the labeling robot system according to the present invention comprises limit switches which regulate the strokes of the vertical, horizontal and rotation air cylinders, said limit switches being connected to a sequence controller, and air circuits for these strokes and for the sucking action connected to an air control box which is also connected to the sequence controller, provides system efficiency from the sucking up of the label through to the adhesive attachment of the label, one system cycle comprising lowering of the head (i.e. the suction plate), sucking up of a label, the raising and turning to the horizontal of the head, advancing the head to the object to be labelled and the sticking of the label thereon, the cessation of the sucking action, horizontal retraction, and rotation downwards.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A labeling robot for picking up a label at a loading position and for applying said label to an article at a label applying position, comprising:

vacuum plate means having surface adapted to pickup and hold a label by a force created by an at least partial vacuum produced between said surface means and said label;

vacuum application means controllably connected to said vacuum plate means;

rotatable vacuum plate support means rotatable about an axis and connected to said vacuum plate means;

horizontally moveable support means connected to said rotatable vacuum plate support means for moving said vacuum plate means between first and second locations which are horizontally displaced from one anther;

vertically movable support means connected to said horizontally movable support means for moving said horizontally movable support means and said vacuum plate means between third and fourth locations which are vertically displaced from one another;

operating means connected to said rotatable vacuum plate support means, to said horizontally movable support means and to said vertically movable support means for controllably moving said surface means for said vacuum plate means between said loading position and said label applying position;

shock absorber means for absorbing any impact force which is produced when said vacuum plate means impacts the article to be labelled; and engagement confirmation means for confirming that said surface means holding the label has engaged said article, the engagement confirmation means including movable means connected with said vacuum plate means for being moved by engagement of said vacuum plate means with the article for generation an indication confirming said engagement and further including a limit switch positioned to be actuated by said movable means for providing an indication that said vacuum plate means has engaged said article.

2. The labeling robot of claim 1 wherein said label has a printed surface which is connectable to said surface means of said vacuum plate means and an adhesive surface opposite to said printed surface.

3. The labeling robot of claim 1 wherein said surface means of said vacuum plate means has a first horizontal orientation when in said loading position, and is rotated 90° from said first horizontal orientation when in said label applying position.

4. The labeling robot of claim 1 wherein said vacuum plate means contains a plurality of vacuum cups distributed over said surface means.

5. The labeling robot of claim 1 wherein said vertically and horizontally movable support means include respective pneumatically operated pistons for their movement.

6. The labeling robot of claim 1 which further includes respective sensing means disposed to sense the strokes of said vertically and horizontally movable support means and the rotation of said rotatable vacuum plate support means to control the limits of their strokes and rotation respectively.

7. The labeling robot of claim 3 which further includes respective sensing means disposed to sense the strokes of said vertically and horizontally movable support means and the rotation of said rotatable vacuum plate support means to control the limits of their strokes and rotation respectively.

8. A labeling robot for picking up a label at a loading position according to claim 1, wherein said shock absorber means is comprised of a spring biased piston rod and further comprising a resilient material disposed between said spring and said vacuum plate means.

9. A labeling robot according to claim 1, wherein said moveable means includes a detector rod which is mechanically coupled to said vacuum plate means and movable thereby when said vacuum plate means contacts said article in a manner which is effective to cause said detector rod to actuate said limit switch.

10. A labeling robot according to claim 1, further comprising a table label pick up confirmation means for detecting whether a label or being held at said surface means.

11. A labeling robot according to claim 10, wherein said label pick up confirmation means includes means for measuring the degree of vacuum prevailing at said surface means.

12. A labeling robot according to claim 11, wherein said label pick up confirmation means comprises a vacuum switch and a suction circuit for coupling the vacuum switch to said vacuum plate means.

* * * * *